US005798501A

United States Patent [19]

Yamane

[11] Patent Number: 5,798,501

[45] Date of Patent: Aug. 25, 1998

[54] METHOD AND APPARATUS FOR TEMPERATURE CONTROL IN PHOTOGRAPH DEVELOPMENT

[75] Inventor: Seiji Yamane, Wakayama, Japan

[73] Assignee: Noritsu Koki Co., Ltd., Wakayama, Japan

[21] Appl. No.: 530,438

[22] Filed: Sep. 19, 1995

[51] Int. Cl.[6] ..... H05B 1/02

[52] U.S. Cl. ..... 219/497; 219/501; 219/508; 219/494

[58] Field of Search ..... 219/494, 492, 219/497, 499, 501, 508; 307/117

[56] References Cited

U.S. PATENT DOCUMENTS

| | | | |
|---|---|---|---|
| 3,858,141 | 12/1974 | Lackey | 219/492 |
| 4,238,672 | 12/1980 | Siess | 219/502 |
| 4,377,738 | 3/1983 | Berg | 219/493 |

*Primary Examiner*—Mark H. Paschall

*Attorney, Agent, or Firm*—Wenderoth, Lind & Ponack, L.L.P.

[57] ABSTRACT

A temperature control system for photograph developer, having a temperature sensor, a heater and a controller which controls the heater in response to the temperature sensor to minimize the initial warm up time of the heater and to regulate the heater to have stable temperature characteristics.

6 Claims, 3 Drawing Sheets

METHOD AND APPARATUS FOR TEMPERATURE CONTROL IN PHOTOGRAPH DEVELOPMENT

FIELD OF INVENTION

This invention relates to temperature control in photograph developing devices.

BACKGROUND OF INVENTION

The developing agent is made more efficient at the optimal temperature, and the finish is better by drying the photosensitive material at the optimal temperature. Therefore, it is necessary to quickly raise the temperature (of developing agents and dryer) to the preset optimal level, and maintain thereafter with minimal variation. Currently, an on/off control system is used. If the temperature is above a preset $\Theta_1$, it remains off and if below $\Theta_1$, it turns on. Consequently, the amplitude of the on-off control cycle is greater (FIG. 5) and unable to maintain established temperatures and therefore affects the quality of the photograph finish.

The proportional control system operates in proportion to the amount of temperature variation. If the temperature is below the proportional or desired temperature range, the heating workload is at 100% capacity. Upon reaching the desired temperature range, the heating is gradually reduced proportionally and when the temperature reaches the pre-set temperature, the heating workload is reduced to 50%

However such device has an inherent disadvantage of requiring longer periods of time to reach pre-set optimal $\Theta_1$ in the desired temperature range (FIG. 6). Also, there is the requirement of conveying the photosensitive material from the printer to the processor, which results in less efficient operation.

This invention's objective is to shorten the initial warm up time and to provide a drying device with a more stabilized temperature control.

SUMMARY OF INVENTION

The temperature control system is characterized by raising the temperature to a pre-set optimal level through on/off control measures and then to maintaining the temperature variation within the desired temperature range through the proportional control system.

The system is capable of controlling (1) heating device for drying and processing; and (2) detecting and maintaining optimal temperature. The off/on control system is utilized until optimal temperature is reached and then to maintain it within the desired temperature range.

By using on/off control system, the time required to read the optimal temperature is shortened and furthermore, temperature variations are minimized.

BRIEF DESCRIPTION OF THE DRAWINGS

Preferred embodiments of the invention will be described in conjunction with the following Figures.

DETAILED DESCRIPTION OF A PREFERRED EMBODIMENT

Figure 1:
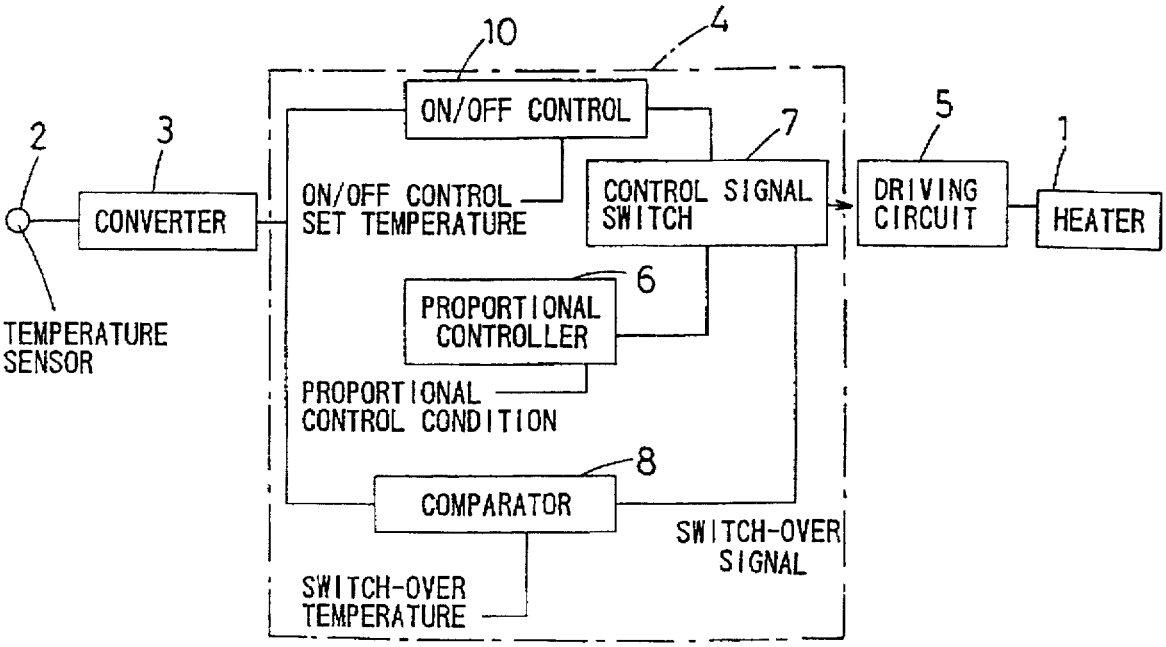
FIG. 1 is a block diagram of the temperature control system

The developer develops the conveyed print paper (photosensitive material) by immersion in the treatment tank, then the fixation tank, followed by rinsing and finally the drying chamber.

The drying chamber is equipped with a heat roller warmed by the heater 1 and thereby drys the prints coming into contact with the surface of the heat roller.

Near the surface of the heat roller is located a heat sensor 2. It transmits data through converter 3 to the control portion 4, which in turn controls operation of heater 1 through driving circuit 5.

The developing treatment tank is equipped with heater 1*a* for heating the developing agent to the desired temperature, and also with temperature sensor 2*a*.

The desired temperature may be preset within certain limits depending on the kind of developing agents and the required development time.

FIG. 1 is a block diagram of heater 1 (for heating photosensitive material) connected to control system control 4 which is equipped with on/off thermostat or temperature control portion 10, proportional controller 6, control signal switch 7 and comparison meter 8.

Comparison meter 8 issues a "switch-over" signal if the temperature exceeds switch-over temperature t. Once signalled, it will continue until the temperature is below (t-$\Delta$t).

Switch 7 will, on input of switch-over signal, switch over to proportional controller or thermostat 6. When switch-over signal is off, return to on/off temperature control portion or thermostat 10.

Figure 2:
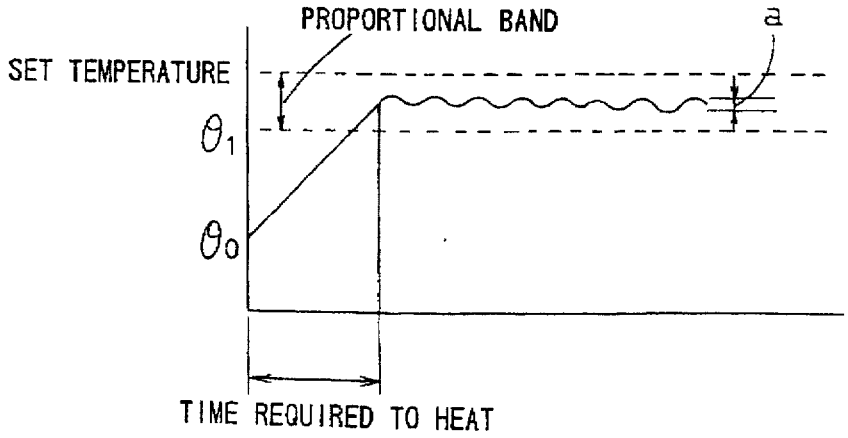
FIG. 2 is a graph which shows the progress of the system

FIG. 2 shows the process of temperature control as described above. In other words, it maintains On from $\Theta_0$ (stand-by) to preset temperature $\Theta_1$. When preset temperature $\Theta_1$ is reached, it changes from on/off control to proportional control and thereby maintains the amplitude of variation within the desired temperature range.

Figure 3:
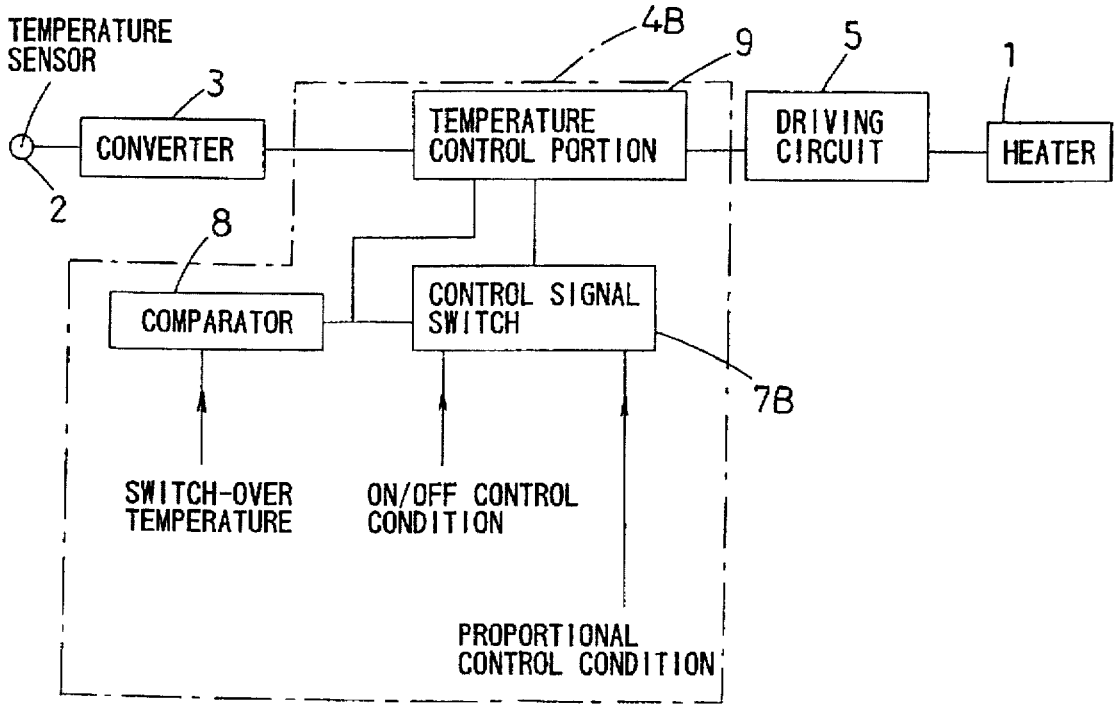
FIG. 3 is a block diagram of the temperature control system operating with software.

FIG. 3 shows control system operated with software. Control system 4B includes temperature control portion or thermostat 9, control signal switch 7*b* and comparison meter 8.

Control signal switch 7*b*, on input of switch-over signal (comparison meter 8) will shift to thermostat 9 (proportional control) and in the absence of shift signal, back to thermostat 9.

Thermostat 9 will shift to proportional control system on input of switch-over signal from comparison meter 8. In the absence of shift signal, it reverts back to on/off system.

Figure 4:
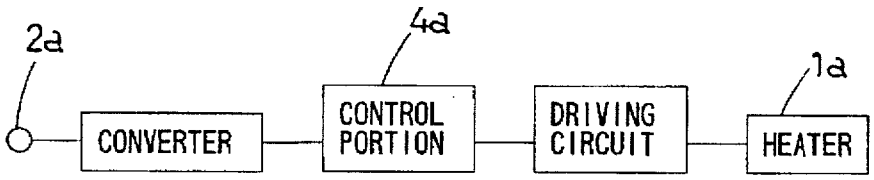
FIG. 4 is a block diagram which shows part of the temperature control system
Figure 5:
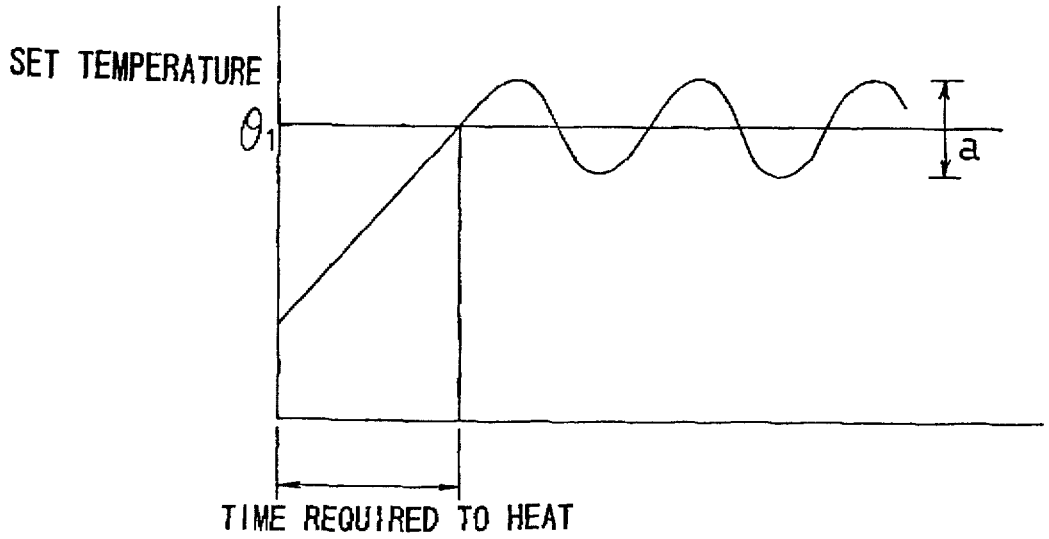
Prior Art Fig. 5
FIG. 5 is a graph which shows the prior art temperature control with on/off system.
Figure 6:
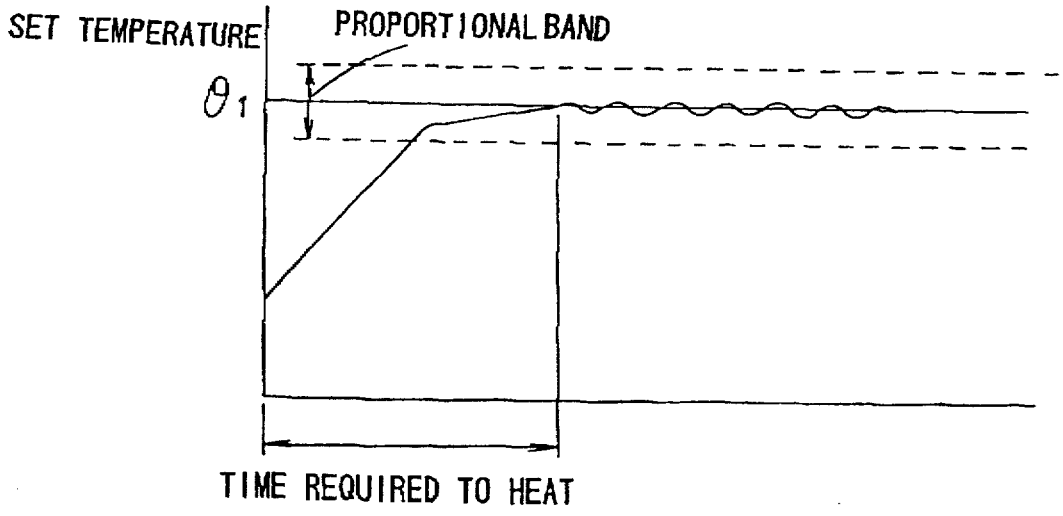
Prior Art Fig. 6
FIG. 6 is a graph which shows the prior art temperature control with proportional control.

FIG. 4 shows control system of heater 1*a* (controlling temperature of developing gent). The composition of control part 4*a* is identical to that of drying heater 1. The said thermostat system is applicable both to the development of films as well as drying.

While a particular embodiment of the invention has been disclosed, it is to be understood that various different modifications are possible and are contemplated as being within the true spirit and scope of the claims.

I claim:

1. A temperature control system for use in photographic development, in which a preset temperature is rapidly reached and accurately maintained within a desired temperature range, said temperature control system comprising:

a heating system having an heating element;

a proportional controller for maintaining an amplitude of variation of the preset temperature of said heating element within the desired temperature range; and a switch for allowing the temperature of said heating element to reach the preset temperature, and for switching a control of said heating element to said proportional controller when the temperature of said heating element has reached the preset temperature.

2. A temperature control system used for heating photographic development agents, in which a preset temperature is rapidly reached and accurately maintained within a desired temperature range, said temperature control system comprising:

a heating system for heating the photographic development agents;

a temperature sensor located near the photographic development agents;

a proportional controller for maintaining an amplitude of variation of the preset temperature of the photographic development agents within the desired temperature range; and a switch for allowing the temperature of the photographic development agents to reach the preset temperature, and for switching a control of said heating system to said proportional controller when the temperature of the photographic development agents has reached the preset temperature.

3. A temperature control system used for heating a photographic material dryer, in which a preset temperature is rapidly reached and accurately maintained within a desired temperature range, said temperature control system comprising:

a heating system for heating the photographic material dryer;

a temperature sensor located near the photographic material dryer;

a proportional controller for maintaining an amplitude of variation of the preset temperature of the photographic material dryer within the desired temperature range; and a switch for allowing the temperature of the photographic material dryer to reach the preset temperature, and for switching a control of said heating system to said proportional controller when the temperature of the photographic material dryer has reached the preset temperature.

4. A temperature control method for use in photographic development, in which a preset temperature is rapidly reached and accurately maintained within a desired temperature range, said temperature control method comprising:

heating an element of a heating system so as to reach the preset temperature; and switching a control of said heating to a proportional control so as to maintain an amplitude of variation of the preset temperature of the element within the desired temperature range when the temperature of the element has reached the preset temperature.

5. A temperature control method used for heating photographic development agents, in which a preset temperature is rapidly reached and accurately maintained within a desired temperature range, said temperature control method comprising:

heating the photographic development agents so as to reach the preset temperature;

detecting the temperature of the photographic developing agents; and switching a control of said heating to a proportional control so as maintain an amplitude of variation of the preset temperature of the photographic development agents within the desired temperature range when the temperature of the photographic development agents has reached the preset temperature.

6. A temperature control method used for heating a photographic material dryer, in which a preset temperature is rapidly reached and accurately maintained within a desired temperature range, said temperature control method comprising:

heating the photographic material dryer so as to reach the preset temperature;

detecting the temperature of the photographic material dryer; and switching a control of said heating to a proportional control so as to maintain an amplitude of variation of the preset temperature of the photographic material dryer within the desired temperature range when the temperature of the photographic material dryer has reached the preset temperature.

* * * * *